US011192229B1

(12) United States Patent
Wilhite

(10) Patent No.: US 11,192,229 B1
(45) Date of Patent: Dec. 7, 2021

(54) MULTI-TOOL HOLDING APPARATUS

(71) Applicant: Robert Chris Wilhite, Valley Center, KS (US)

(72) Inventor: Robert Chris Wilhite, Valley Center, KS (US)

( * ) Notice: Subject to any disclaimer, the term of this patent is extended or adjusted under 35 U.S.C. 154(b) by 0 days.

(21) Appl. No.: 17/369,313

(22) Filed: Jul. 7, 2021

(51) Int. Cl.

| | |
|---|---|
| ***B25F 1/00*** | (2006.01) |
| ***B25C 11/00*** | (2006.01) |
| ***B66F 15/00*** | (2006.01) |
| ***B25D 7/00*** | (2006.01) |
| ***A62C 8/04*** | (2006.01) |

(52) U.S. Cl.
CPC ..... *B25F 1/006* (2013.01); *A62C 8/04* (2013.01); *B25C 11/00* (2013.01); *B25D 7/00* (2013.01); *B66F 15/00* (2013.01)

(58) Field of Classification Search
CPC . B25F 1/006; B66F 15/00; A62C 8/04; B25C 11/00; B25D 7/00
See application file for complete search history.

(56) References Cited

U.S. PATENT DOCUMENTS

| | | | | |
|---|---|---|---|---|
| 6,718,586 | B2 | 4/2004 | Corsini | |
| 9,914,203 | B2 | 3/2018 | Orine, III | |
| 2005/0283916 | A1* | 12/2005 | Gintz | B25D 1/00 7/144 |
| 2013/0112045 | A1 | 5/2013 | Piveronas | |

* cited by examiner

*Primary Examiner* — David B. Thomas
(74) *Attorney, Agent, or Firm* — Dale J. Ream

(57) ABSTRACT

A multi-tool holding apparatus includes a first portion having a plurality of sides which define a circular channel that is able to be releasably secured around a fire hook. This release-ability is enabled by an opening on one side of this plurality of sides that is able to be screwed together, allowing for the circular channel defined to frictionally encompass the fire hook. This multi-tool holding apparatus also has a second portion having a neck coupled by a securing member, that forms a T-shaped component enabling secured frictional placement of a Halligan tool.

12 Claims, 3 Drawing Sheets

MULTI-TOOL HOLDING APPARATUS

BACKGROUND OF THE INVENTION

This invention relates generally to tool holding devices and, more particularly, to a multi-tool holding apparatus for frictional attachment of multiple firefighting tools and useful for more efficient tool retrieval and ergonomic tool carrying.

Firefighters use various tools during the process of fighting fire. For instance, firefighters may use what is commonly referred to as a Halligan or, generically, as a Halligan tool. The Halligan tool was invented in the late 1940s by FDNY Fire Chief Hugh Halligan and is considered one of the most effective forcible entry tools firefighters can have at their disposal. The Halligan tool was originally conceived of as a forcible entry tool. Its versatility has led to recognition for a range of emergency applications. In addition to locked doors, the Halligan can be used to open padlocks and break chains. And in particularly difficult forcible entry scenarios, the Halligan can also be used to remove hinge pins or even an entire door.

Another standard tool used by firefighters is a traditional fire hook. Fire hooks are tools used to probe difficult to reach spaces, along with tearing down ceilings and walls. Due to the immediate danger that fires create, it is imperative that firefighters have quick and reliable access to these tools. The efficient and reliable access that the tool coupling device 10 provides firefighters, could be significant in determining whether individuals trapped inside burning areas are able to be rescued before succumbing to smoke inhalation, burns, or injury from falling debris.

Various devices have been proposed in prior patents for marrying two tools together. Although presumably effective for their intended purposes, the existing proposals are inadequate for securely and operatively coupling a Halligan tool and fire hook together in a manner that allows for the quick and reliable combination or release of both tools. Being able to single-handedly carry both tools into a burning structure is advantageous or even critical to the success and potentially life-saving role of a firefighter.

Therefore, it would be desirable to have a multi-tool holding apparatus having a first portion defining a generally circular or cylindrical channel that is operative to frictionally hold a first tool (e.g., a fireman's hook) coupled to a second portion having a T-shaped configuration for holding a Halligan tool in a wedged frictional configuration. Further, it would be desirable to have a multi-tool holding apparatus in which the Halligan may be released from the second portion with one or two gentle "bumps." In addition, it would be desirable to have a multi-tool holding apparatus that could be attached to, or removed from, the fire hook enabling the operator to personalize his/her equipment to differentiate its functionality. Specifically, the first portion of the multi-tool holding apparatus may be loosened so as to slide up or down along the longitudinal axis of the first tool so such that the second portion is capable of receiving multiple configurations and sizes of Halligan tools.

SUMMARY OF THE INVENTION

A multi-tool holding apparatus, according to the present invention, includes two portions, a first portion having a plurality of side walls that form a front and rear portion which are separated by an opening with 3 screw holes present on the two adjacent sides to said opening, positioned such that, when screwed together, form a channel operative to releasably secure the fireman's hook. It is understood that the diameter of the opening may be increased or decreased (by loosening or tightening of the screws) so as to be slidably adjustable along the longitudinal axis of a first tool). Further, the apparatus includes a second portion having a neck coupled to and extending away from a respective side wall of said first portion and a T-shaped securing member coupled to the end of the neck and positioned so as to prevent outward movement of the Halligan tool.

Therefore, a general object of this invention is to provide a multi-tool holding apparatus that enables two firefighting tools to be secured together and carried single handedly into a firefighting environment.

Another object of this invention is to provide a multi-tool holding apparatus, as aforesaid, which creates sufficient friction to ensure that continuous coupling between a Halligan and the holding apparatus is achieved until the operator decides to intentionally de-couple the two tools by tapping the fire hook gently on the ground 1-2 times.

Still another object of this invention is to provide a multi-tool holding apparatus, as aforesaid, plurality of side walls that define a circular channel and have a single opening, with three screws on the two sides adjacent to that opening, positioned that, when screwed together, form a channel operative to releasably envelop a section of the perimeter of a fire hook.

Yet another object of this invention is to provide a multi-tool holding apparatus, as aforesaid, that ensures the quick coupling and de-coupling of a Halligan and a fire hook whenever the operator determines this coupling or de-coupling should take place.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
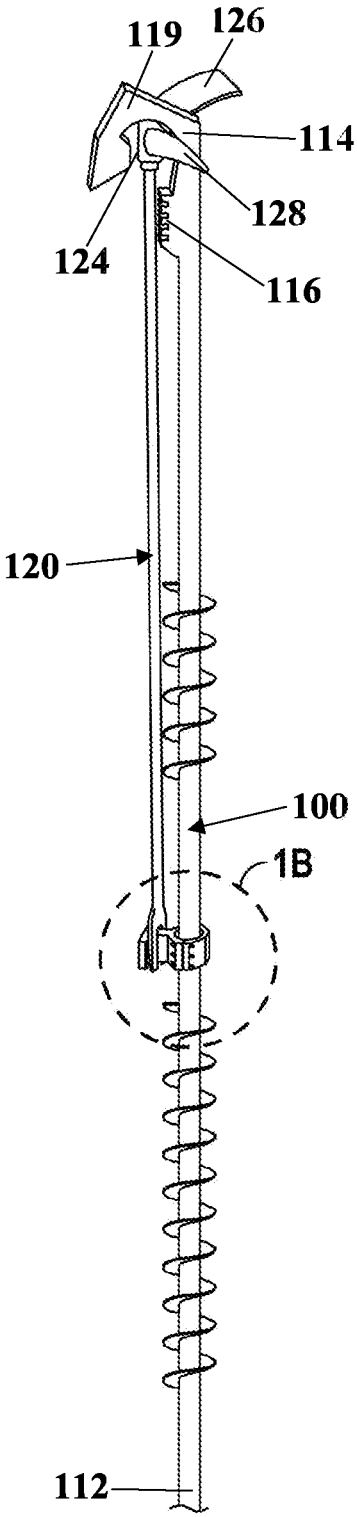
FIG. 1*a* is a multi-tool holding apparatus according to a preferred embodiment of the present invention, illustrated securing a pair of fireman's tools for context.
Figure 1B:
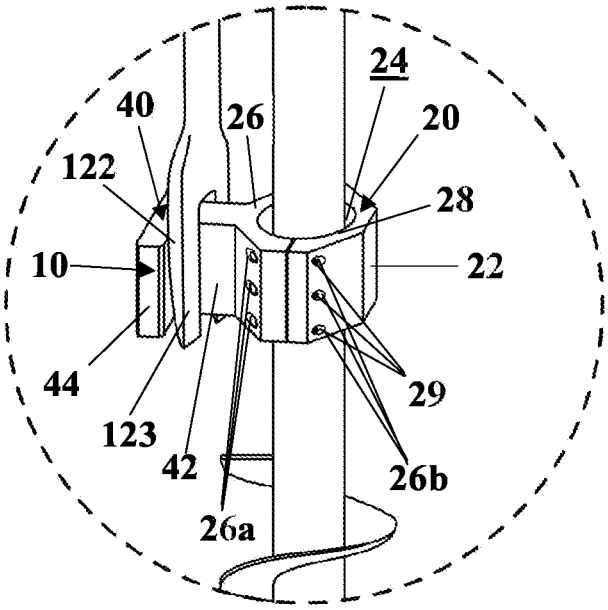
FIG. 1*b* is an isolated view on an enlarged scale taken from FIG. 1*a;*
Figure 2:
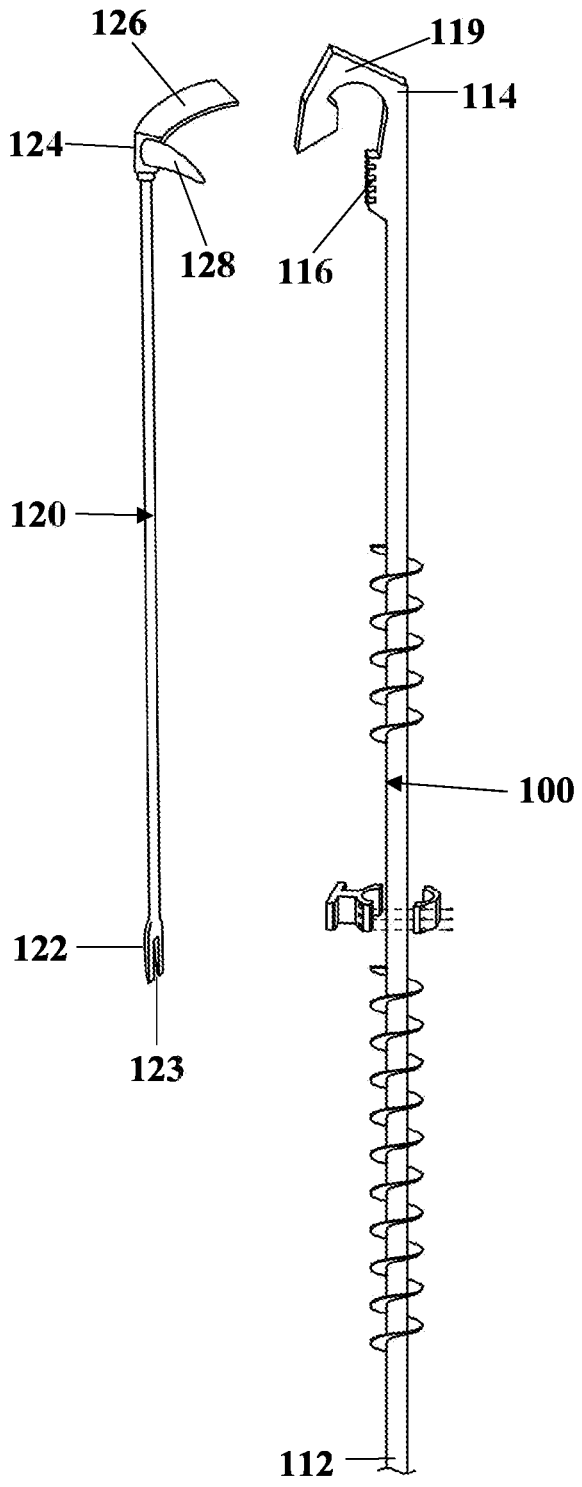
FIG. 2 is an exploded view of the multi-tool holding apparatus as in FIG. 1.

A multi-tool holding apparatus according to a preferred embodiment of the present invention will now be described with reference to FIG. 1*a* to FIG. 5 of the accompanying drawings. The multi-tool holding apparatus 10 includes a first portion 20 useful for releasably securing a fireman's hook tool 100 and a second portion 40 having a configuration for releasably securing or wedging a Halligan tool 120.

To give context to the multi-tool holding apparatus 10, the tools it is designed to carry will be described. The fireman's hook 100 is essentially a rod having an elongate and linear configuration. More particularly, the fireman's hook 100 has a first end 112 and a second end 114 opposite the first end 112 and a body portion 114 extending therebetween. The fireman's hook 100 may include an outward protruding surface 116 for a coupled tool to wrest onto and an all-purpose head 119 used for probing difficult to reach spaces, as well as cutting into ceilings, walls, and obstacles.

Further, the multi-tool holding apparatus 10 is useful for securing a Halligan tool. The Halligan tool 120 may include a proximal end 122 and a distal end 124 opposite the proximal end 122 and may also have a generally elongate and linear configuration although generally about half the length of the fireman's hook 100.

The proximal end 122 of a Halligan tool 120 has a fork configuration 123 that selectively engages the second portion 40 of the multi-tool holding apparatus 10 as will be described later. More specifically, in an embodiment, the inside of the fork configuration 123 becomes wedged around a neck 42, whereas the outside of the fork configuration 123 becomes wedged in-between the securing member 44 and side walls 22.

The distal end 124 of a Halligan tool 120 may include a duckbill 126 and a pike 128 which create a right angle in relation to the other. In an embodiment, the intersection of the duckbill 126 and pike 128 can be wrested in-between the fire hook's 100 all-purpose head 119. This occurs when the proximal end 122 of the Halligan 120 selectively engages the second portion 40 of the multi-tool holding apparatus 10. Further, the body of the Halligan 120 can be wrested against the fire hook's outward surface 116, when the aforesaid components are selectively engaged.

Figure 4:
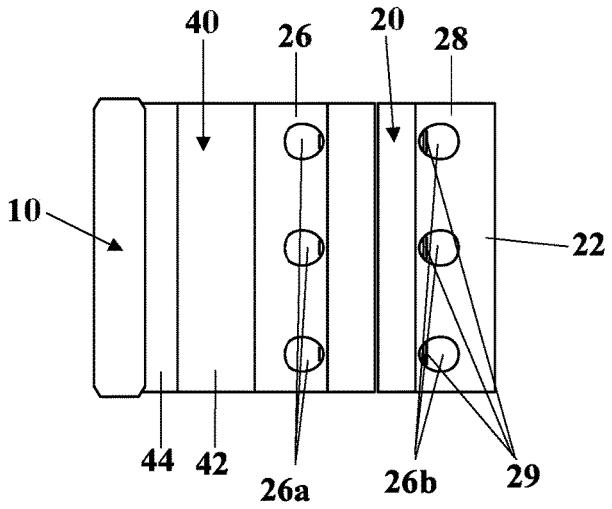
FIG. 4 is a side view of the multi-tool holding apparatus according to the present invention.
Figure 5:
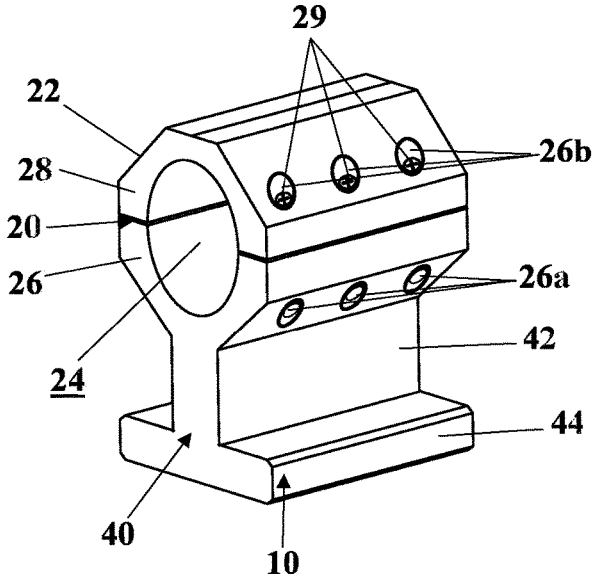
FIG. 5 is a perspective view of the multi-tool holding apparatus according to a preferred embodiment of the present invention.

The multi-tool holding apparatus 10 will now be described in detail. The multi-tool holding apparatus 10 includes a first portion 20 useful for releasably securing a fireman's hook tool 100 and a second portion 40 having a configuration for releasably securing or wedging a Halligan tool 120. It is understood that the first portion 20 and the second portion 40 may be constructed of plastic or metal. In an embodiment, the first portion 20 includes a plurality of side walls 22 arranged in an octagonal pattern that, together, define a circular or cylindrical channel, also referred to as an opening 24. This circular channel 24 creates an appropriate radius that can be secured around the body portion 114 or rod of the fireman's hook tool 100. Further, FIGS. 4 and 5 illustrate that respective side walls 22 of the first portion 20 defines an opening and defines three screw holes 29 located on the sides 22 adjacent said opening. In an embodiment, these screw holes can be screwed together securely closing the opening between the upper section 28 and lower section 26, enabling the first portion 20 to be secured/tightened around a fireman's hook 100 (FIG. 1*a*). Even more specifically, the first portion 20 may include a lower section 26 having a generally hemispherical configuration that is outwardly open. Similarly, the first portion 20 may include an upper section 28 also having a generally hemispherical configuration that is outwardly open. The first and second portions may be pulled apart when not fastened together. In other words, the first portion 20 is movable between a released configuration in which the upper and lower sections 26, 28 are displaced from one another and a secured configuration in which the upper and lower sections 26, 28 are coupled together. In an embodiment, the upper and lower sections 26, 28 may each define a plurality of bores 26*a*, 26*b* that, when registered with one another, may be secured using screws 29 or other fasteners. It will be understood that when the upper section 28 is described as being positioned atop the lower section 26, it is understood that the meaning is that the hemispherical areas face one another so that, together, they form a cylindrical channel capable of receiving the body portion 114 or rod of the fireman's hook 100 in a secure and nested configuration.

In use, the screws which hold together the upper and lower sections 26, 28 may be loosened or even removed such that the upper and lower sections 26, 28 become partly or completely separated relative to one another. In other words, the diameter of the opening 24 is increased and the entire multi-tool holding apparatus 10 may be slidably moved up or down along the longitudinal axis of the fireman's hook 100. Then, the screws may be replaced and tightened within respective bores 26*a*, 26*b*. The multi-tool holding apparatus 10 is now secured at another location and may be better suited to support a Halligan tool 120 having different specifications, i.e., a different brand.

Figure 3:
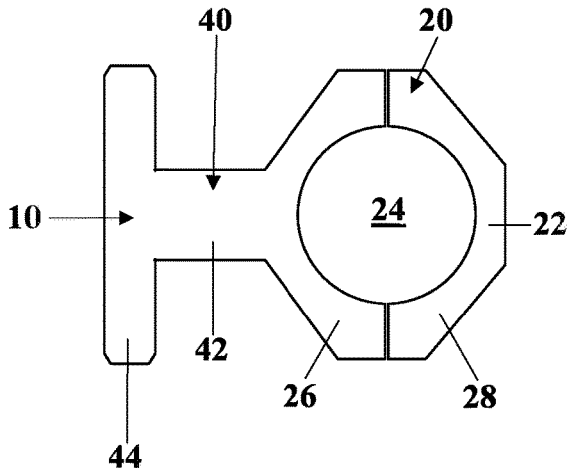
FIG. 3 is a top view of the multi-tool holding apparatus according to the present invention.

Further, the multi-tool holding apparatus 10 includes a second portion 40 fixedly coupled to an outer surface of a respective side wall 22 and extends away therefrom (FIGS. 3 and 5). More particularly, the second portion 40 may include a neck 42 that is fixedly coupled to the respective side wall 22 and securing member 44 coupled to an outer edge of the neck 22 and in a perpendicular geometry that is effective to keep the forked end of a Halligan tool wedged to the neck 42 as will be described later. Thus, the second portion 40 may have a T-shaped configuration. In an embodiment, the multi-tool apparatus 10 is able to receive and secure the proximal end 122 of the Halligan 120, through the neck's 42 ability to be encompassed by the inside of the fork configuration 123 of the Halligan 120, and also, by the securing member 44 and plurality of side walls 22 ability to secure the outside of the fork configuration 123 in place.

In use, the multi-tool holding apparatus 10 enables a firefighter to securely carry a Halligan tool 120 and fireman's hook 100 tool in one hand, while also allowing for the quick coupling of these two tools, as well as, quick release of the two tools from their coupled state whenever desired.

It is understood that while certain forms of this invention have been illustrated and described, it is not limited thereto except insofar as such limitations are included in the following claims and allowable functional equivalents thereof.

The invention claimed is:

1. A multi-tool holding apparatus for securing a Halligan tool and a fireman's hook such that a firefighter may singlehandedly carry both tools into a firefighting environment, said multi-tool holding apparatus comprising:

a first portion having a plurality of side walls that, together, form a channel operative to releasably secure the fireman's hook; and a second portion having a neck coupled to and extending away from a respective side wall of said first portion and a securing member coupled to said neck and positioned so as to prevent outward movement of the Halligan tool.

2. The multi-tool holding apparatus as in claim 1, wherein said plurality of side walls of said first portion each includes:

an exterior surface that is planar and that is angularly offset from an adjacent exterior surface such that respective side walls have an octagonal configuration;

an interior surface having a concave configuration such that said plurality of side walls, together, define said channel operative to releasably receive the fireman's hook.

3. The multi-tool holding apparatus as in claim 2, wherein said first portion has a generally elongate configuration and said channel has a generally cylindrical configuration.

4. The multi-tool holding apparatus as in claim 2, wherein:

said first portion includes:

a lower body member having a generally hemispherical configuration defining a lower interior space;

an upper body member having a generally hemispherical configuration defining an upper interior space;

said first portion is movable between a released configuration in which said upper body member is displaced from said lower body member so as to enable a body portion of the fireman's hook to be nested in said lower interior space, and a secured configuration in which said upper body member is positioned atop said lower body member such that said body portion of the fireman's hook is sandwiched between said lower body member and set upper body member.

5. The multi-tool holding apparatus as in claim 4, wherein:

a respective side wall of said lower body member defines a plurality of lower bores;

a respective side wall of said upper body member defines a plurality of upper bores;

said first portion is in said secured configuration when said upper body member is positioned atop said lower body member and a plurality of screws are inserted through said plurality of lower bores and said plurality of upper bores.

6. The multi-tool holding apparatus as in claim 4, wherein said neck includes a first end coupled to said lower body member and a second end opposite said first end that is coupled to said securing member.

7. The multi-tool holding apparatus as in claim 6, wherein said securing member is perpendicular to said neck such that said neck and said securing member, when viewed together, have a T-shaped configuration.

8. The multi-tool holding apparatus as in claim 6, wherein said first portion and said second portion are constructed of a plastic material.

9. The multi-tool holding apparatus as in claim 6, wherein said first portion and said second portion are constructed of metal.

10. A multi-tool holding apparatus for securing a Halligan tool and a fireman's hook such that a firefighter may singlehandedly carry both tools into a firefighting environment, said multi-tool holding apparatus comprising:

a first portion having a plurality of side walls that, together, form a channel operative to releasably secure the fireman's hook; and a second portion having a neck coupled to and extending away from a respective side wall of said first portion and a securing member coupled to said neck and positioned so as to prevent outward movement of the Halligan tool;

wherein said first portion includes:

a lower body member having a generally hemispherical configuration defining a lower interior space;

an upper body member having a generally hemispherical configuration defining an upper interior space;

wherein said first portion is movable between a released configuration in which said upper body member is displaced from said lower body member so as to enable a body portion of the fireman's hook to be nested in said lower interior space, and a secured configuration in which said upper body member is positioned atop said lower body member such that said body portion of the fireman's hook is sandwiched between said lower body member and set upper body member.

11. The multi-tool holding apparatus as in claim 10, wherein said neck includes a first end coupled to said lower body member and a second end opposite said first end that is coupled to said securing member.

12. The multi-tool holding apparatus as in claim 11, wherein said securing member is perpendicular to said neck such that said neck and said securing member, when viewed together, have a T-shaped configuration.

* * * * *